United States Patent [19]

Pollich

[11] Patent Number: 4,702,468

[45] **Date of Patent: * Oct. 27, 1987**

[54] DEVICE IN THE DELIVERY OF SHEET-FED ROTARY PRINTING MACHINE FOR EXHIBITING CURL FORMATION ON THE LEADING EDGE OF A DELIVERED SHEET

[75] Inventor: Gerhard Pollich, Heidelberg, Fed. Rep. of Germany

[73] Assignee: Heidelberger Druckmaschinen AG, Heidelberg, Fed. Rep. of Germany

[ * ] Notice: The portion of the term of this patent subsequent to May 31, 2002 has been disclaimed.

[21] Appl. No.: 786,849

[22] Filed: Oct. 11, 1985

Related U.S. Application Data

[63] Continuation-in-part of Ser. No. 403,794, Jul. 30, 1982, Pat. No. 4,561,645.

[51] Int. Cl.[4] ..... B65H 29/24

[52] U.S. Cl. ..... 271/195; 271/211

[58] Field of Search ..... 271/195, 211, 188, 236, 271/250, 251

[56] References Cited

U.S. PATENT DOCUMENTS

| | | | |
|---|---|---|---|
| 1,623,195 | 4/1927 | Maxner | 271/211 |
| 1,743,921 | 1/1930 | Kerly | 271/211 |
| 3,624,807 | 11/1971 | Schwebel | 271/236 |
| 3,727,911 | 4/1973 | Vits | 271/195 |
| 4,033,579 | 7/1977 | Stange | 271/195 |
| 4,073,001 | 2/1978 | Stange | 271/195 X |
| 4,131,320 | 12/1978 | Volat | 271/195 X |
| 4,132,400 | 1/1979 | Naramore | 271/211 X |
| 4,372,550 | 2/1983 | Woods | 271/211 |
| 4,395,038 | 7/1983 | Fitzpatrick | 271/195 |
| 4,561,645 | 12/1985 | Pollich | 271/195 |

*Primary Examiner*—Richard A. Schacher

*Attorney, Agent, or Firm*—Herbert L. Lerner; Laurence A. Greenberg

[57] ABSTRACT

A delivery system of a sheet-fed rotary printing machine having a conveyor for transporting a sheet in a given travel direction to a location of the delivery system at which a stack of sheets is deposited, a device for inhibiting curl formation in a leading edge of the sheet includes a device for downwardly directing the sheet at the location at which the stack of sheets is deposited, and blowing units exclusively disposed at a location of the delivery system whereat, as viewed in the given travel direction of the sheet, a forward region of the stack of delivered sheets and a leading edge of the downwardly directed sheet are disposed, the blowing units having a respective device located at opposite sides of the forward region of the stack and at opposite edges of the sheet adjacent the leading edge thereof for directing a controlled air jet substantially parallel to the sheet, with one directional component in the travel direction of the sheet and another directional component towards the middle of the sheet, along the underside of the downwardly directed sheet in vicinity of the leading edge of the sheet tending to curl.

4 Claims, 6 Drawing Figures

DEVICE IN THE DELIVERY OF SHEET-FED ROTARY PRINTING MACHINE FOR EXHIBITING CURL FORMATION ON THE LEADING EDGE OF A DELIVERED SHEET

This is a continuation-in-part of application Ser. No. 403,794, filed July 30, 1982 now patented under U.S. Pat. No. 4,561,645.

The invention relates to a device in the delivery of a sheet-fed rotary printing machine capable of inhibiting curl formation in or roll-up of the leading edge of a delivered sheet.

Due to the application of ink on one side of a paper sheet, the latter develops a tendency to roll up or curl from the leading and trailing edge, respectively, thereof. This phenomenon may generally be countered with so-called sheet decurlers which are usually disposed likewise in the sheet delivery system after the final guide cylinder. Such decurlers, which are usually disposed between two round rods extending over the entire width of the sheet and between which, likewise, suction air acting over the entire width of the sheet is caused to take effect, ensure, in most cases, the arrival of the printed paper sheet into the sheet delivery system nearly flatly and without any curled or rolled-up ends.

Especially, however, in the case of paper sheets printed in more than one color and, under certain conditions, even lacquered in the final printing unit, the inclination or tendency toward curling or roll-up can be so strong that, in spite of the sheet decurlers which have been provided, the leading edge of the sheets become curled, nevertheless. Moreover, even a desirably positioned sheet curler requires a measurable initial suction period to be effective so that a speed-dependent length of the sheet, measured from the leading edge thereof, still has a tendency to curl or roll up. Even if air jets are used to blow the sheet additionally against the sheet decurler, the desired result is not obtained, especially when the paper sheet is multi-color-printed and possibly lacquered.

Depending upon the manner of operation of the sheet delivery system, the curling or rolling-up of the leading edge of the sheet occurs immediately after the grippers transporting the sheets have opened with the result that, indeed, the corners of the leading edge of the sheet are already curled or rolled up before the sheet to be delivered has come to rest upon the stack. This causes considerable trouble in forming the stack, which becomes all the greater if, moveover, the printing machine is being operated at a high speed.

In view of the foregoing problems, it is accordingly an object of the invention to provide a device in the delivery system of sheet-fed rotary printing machines for inhibiting curl formation in the leading edge of a delivered sheet after it has been freed from the grippers, which functions more reliably than heretofore known devices of this general type, even under extreme working conditions.

With the foregoing and other objects in view, there is provided, in accordance with the invention, in a delivery system of a sheet-fed rotary printing machine having a conveyor for transporting a sheet in a given travel direction to a location of the delivery system at which a stack of sheets is deposited, a device for inhibiting curl formation in a leading edge of the sheet, comprising means for downwardly directing the sheet at the location at which the stack of sheets is deposited, and blowing units exclusively disposed at a location of the delivery system whereat, as viewed in the given travel direction of the sheet, a forward region of the stack of delivered sheets and a leading edge of the downwardly directed sheet are disposed, the blowing units having respective means located at opposite sides of the forward region of the stack and at opposite edges of the sheet adjacent the leading edge thereof for directing a controlled air jet substantially parallel to the sheet, with one directional component in the travel direction of the sheet and another directional component towards the middle of the sheet, along the underside of the downwardly directed sheet in vicinity of the leading edge of the sheet tending to curl.

It has already become known heretofore (German Pat. No. 24 59 862), in the case of traveling webs, for example textile woven or knitted fabrics, foils or synthetic material, paper, and the like, to smoothen and uncurl the edges of the material if it has become folded or wrapped and especially curled up at one or the other side of the web transversely to the web and out of the plane of the web, with a corresponding reduction in the width of the web. For this purpose edge rollers are used which are provided with a guide surface whereon the web is guided on the side thereof opposite the curled side and, furthermore, a device is provided for producing an air jet for rolling the curled edge out flatly, the air jet being directed outwardly against the curled edge on the curled side of the web substantially parallel to the guide surface and in travel direction of the web along the curled edge over the guide surface.

These heretofore known edge rollers are not suited at all for inhibiting or overcoming the tendency of paper sheets to curl in the delivery systems of sheet-fed rotary printing machines because of the fact alone that the paper sheets to be delivered cannot travel past the blowing device downwardly out to the stack.

In accordance with another feature of the invention, the air jet has a given scattering range in the plane of the sheet.

In accordance with a further feature of the invention, the blowing units have means for continuously operating the air jets.

In accordance with an additional feature of the invention, the blowing units have means for operating the air jets at regular time intervals matching the speed of the sheet delivery.

In accordance with an added feature of the invention, the blowing units, respectively, comprise a housing block formed with a threaded bore and air outlet openings for supplying air thereto via a hose connection and a check valve, and including fastening means for fastening the housing block to a respective lateral sheet straightener.

In accordance with yet another feature of the invention, the housing block is formed as a substantially rectangular cylinder, and the sheet straightener is located at a side of the delivery, and including a bracket formed with a threaded pin projecting through an elongated slot formed in the sheet straightener, the bracket being connected to the sheet straightener by a nut threadedly tightened on the threaded pin, and further including retaining screws fixing the housing block to the bracket, the housing block having a substantially rectangular side having a leveled region wherein the air outlet openings are formed.

In accordance with yet a further feature of the invention, the housing block is cylindrical with a circular cross section and has a threaded pin projecting through an elongated slot formed in the lateral sheet straightener, and including a lock nut tightened on the threaded pin for positively fastening the housing block to the lateral sheet straightener.

In accordance with yet an additional feature of the invention the blowing unit is slidable in the elongated slot formed in the lateral sheet straightener selectively in direction of sheet travel and opposite thereto and is fixable in position.

In accordance with yet an added feature of the invention, the blowing unit is turnable about the longitudinal axis thereof and fixable in position.

Other features which are considered as characteristic for the invention are set forth in the appended claims.

Although the invention is illustrated and described herein as embodied in device in the delivery of sheet-fed rotary printing machine for inhibiting curl formation in the leading edge of a delivered sheet, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
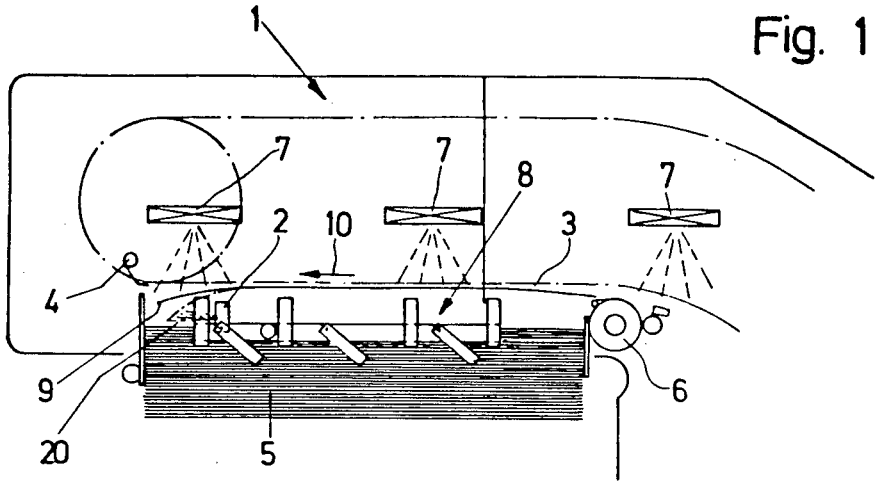
FIG. 1 is a diagrammatic side elevational view of a sheet delivery system wherein the position of the device for inhibiting or overcoming curl formation in the leading edge of a delivered sheet, in accordance with the invention, is shown.
Figure 2:
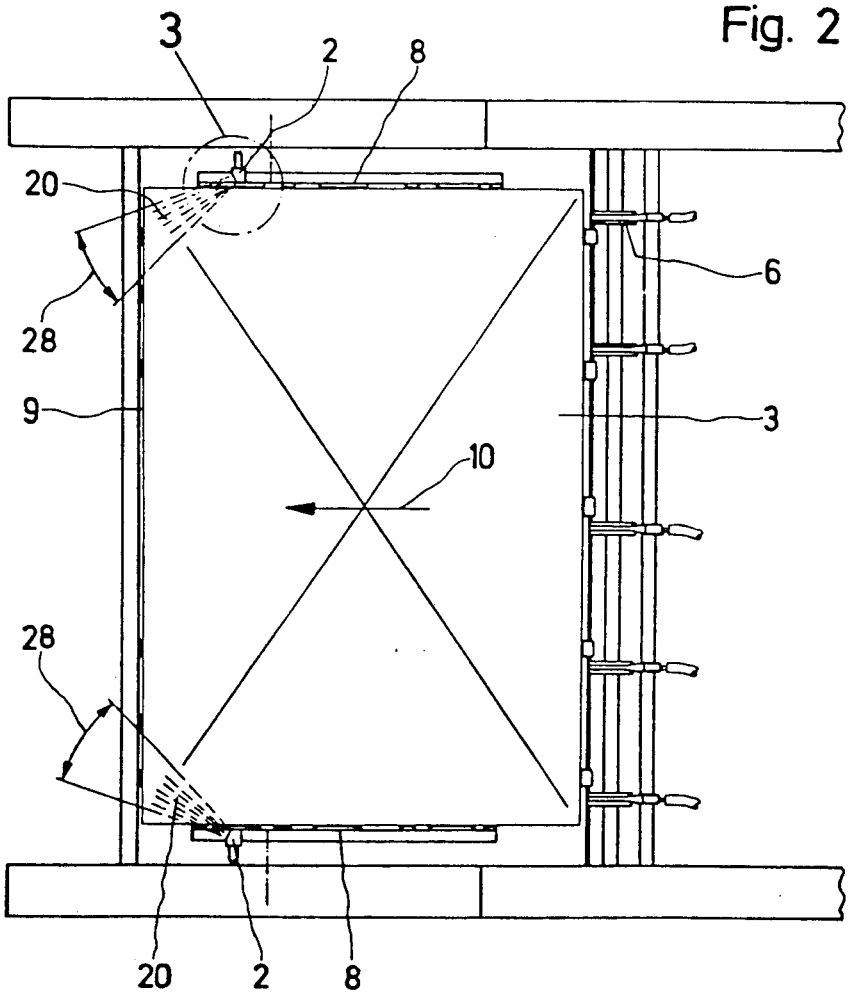
FIG. 2 is a top plan view of FIG. 1 in which, moreover, the preferred blowing direction of the device according to the invention is seen.

Referring now to the drawing and first, particularly, to FIG. 1 and 2 thereof, there is shown in the respective side elevational and top plan views of a sheet delivery system 1, the desired position of a blowing unit 2 according to the invention.

A sheet 3 coming from a non-illustrated last printing unit is transported by means of grippers 4 up to the delivery position thereof above a stack 5 of previously delivered sheets and then released. Suction devices 6 disposed in vicinity of the trailing edge of the sheet 3 brake the latter, while fans 7 disposed above the sheet 3 to be delivered accelerate the delivery by increasing the speed at which the sheet 3 descends.

Blowing units 2,20 provided at both sides of the sheet 3 to be delivered are advantageously attached to lateral sheet straighteners 8 in the illustrated embodiments. Disposed in vicinity of the leading edge 9 of the sheet 3, the blowing units 2,20, as shown in FIGS. 1 and 2, blow air jets in travel direction 10 of the sheet 3 as well as towards the middle of the sheet 3 and substantially parallel to the plane of the sheet 3. Conventional throttle valves 30 connected in respective pressurized air lines extending from an air-pressure source P to the blowing units 2, 20 serve for controlling the rate of air supply to the latter.

Figure 3:
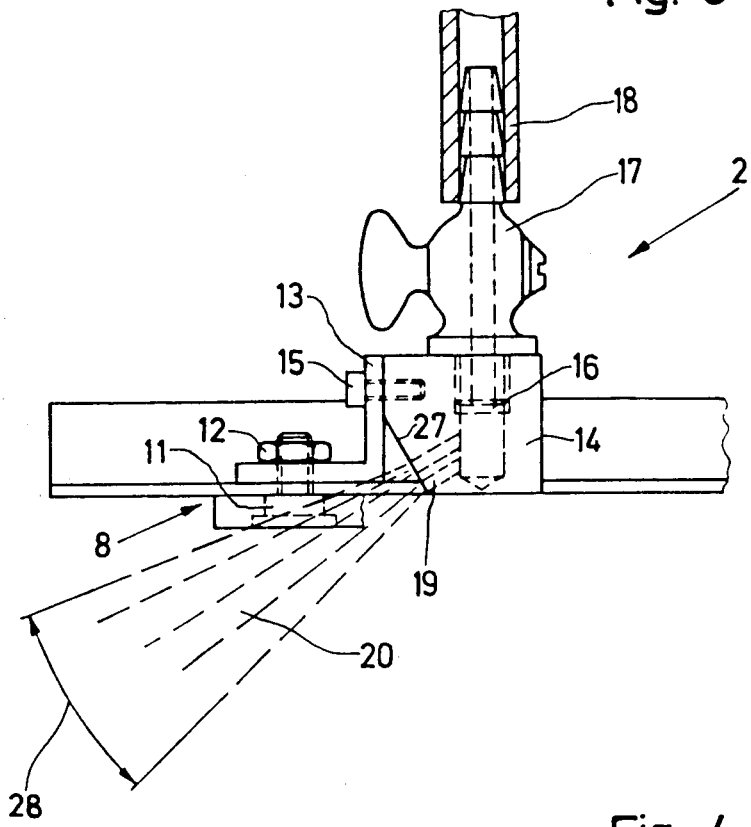
FIG. 3 is an enlarged fragmentary view of FIG. 2 showing the blowing unit appearing in the circle shown in phantom.
Figure 4:
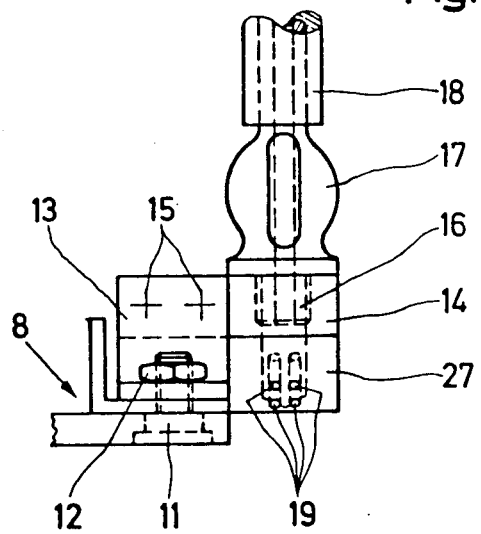
FIG. 4 is a left-hand side elevational view of FIG. 3.

FIG. 3 shows a first embodiment of the blowing unit 2 according to the invention. In this regard, a retaining clip or bracket 13 is fastened by means of suitable fastening means 11,12 to the lateral sheet straighteners 8. A housing block 14 forming an essential component of the blowing units 2 is fastened, in turn, to the bracket 13 by means of retaining screws 15. A check valve of shut-off valve 17 for controlling the air supply is screwed into a threaded bore 16 formed in the housing block 14. A hose 18 connected thereto provides a further connection to a non-illustrated compressed-air supply. Air outlet bores or openings 19 machined in the housing block 14 terminate in the threaded bore 16 and, together with the latter, ensure the desired guidance of the compressed or blowing air jet 20 from a beveled surface 27 of the housing block 14. The side view of FIG. 3 as shown in FIG. 4 serves to clarify the construction of the blowing unit.

Figure 5:
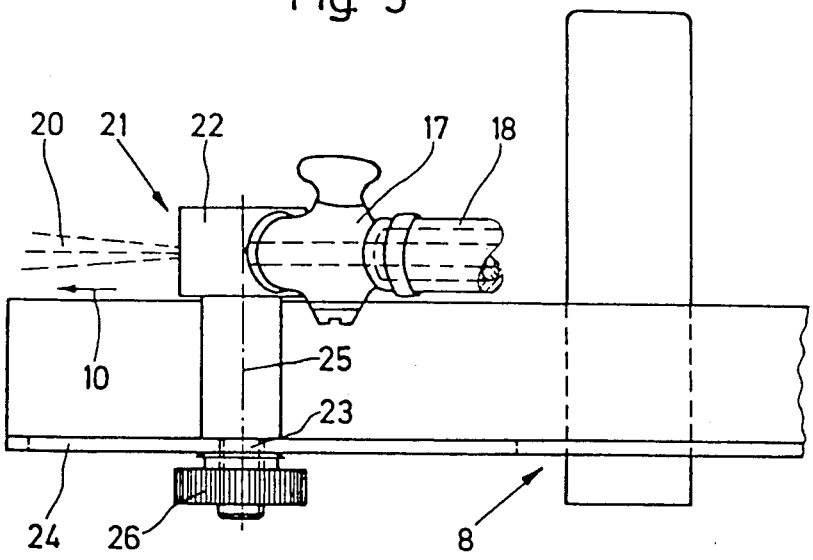
FIG. 5 is a view of another embodiment of the blowing unit.
Figure 6:
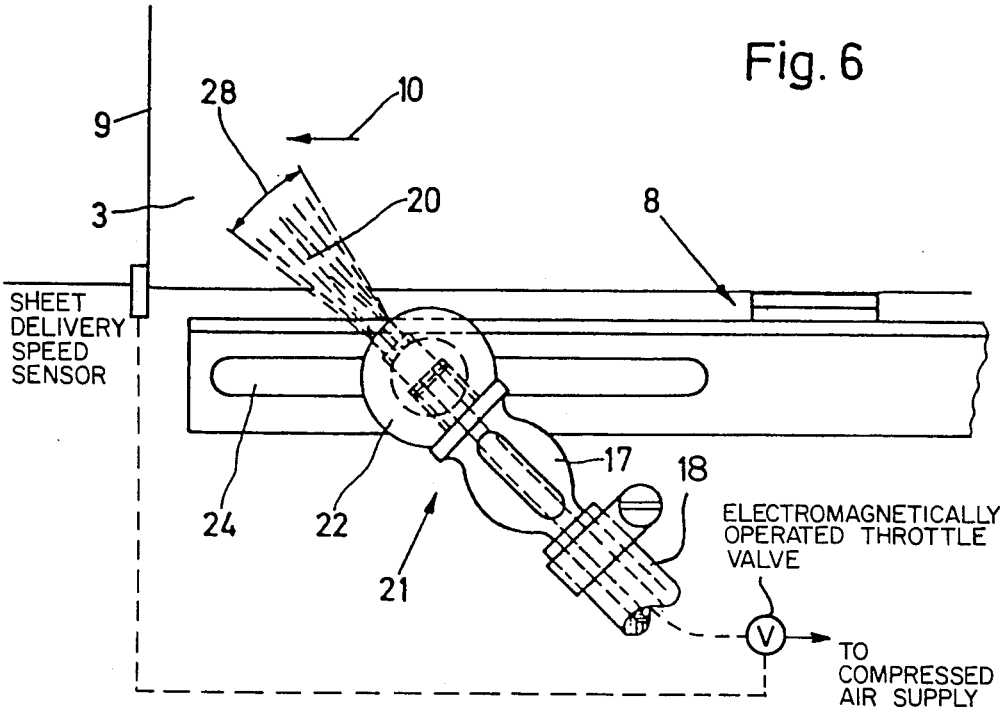
FIG. 6 is a top plan view of FIG. 5.

FIGS. 5 and 6 show, in respective side and plan views, a further embodiment of the blowing unit 21 according to the invention. In this case as well, a blowing unit 21 is disposed at each side of the paper sheet 3 at the lateral sheet straighteners 8 (note FIGS. 1 and 2). The essential differences of the embodiment of FIGS. 5 and 6 with respect to the embodiment of FIGS. 3 and 4 are that the housing block 22 is of somewhat different construction i.e. has a circular cross section, as well as being provided with a threaded pin 23. The latter projects through an elongated slot 24 formed in the lateral sheet straightener 8 and thereby permits turning of the housing block 22 about the longitudinal axis 26 thereof, as well as displacement in axial or longitudinal direction thereof, in the direction 10 of paper travel and opposite to the direction of paper travel, respectively. When the selected adjustment or setting has been attained, a tight connection between the blowing unit 21 and the respective lateral sheet straightener 8 may be produced by means of a locking bolt or nut 26.

The embodiment of FIGS. 5 and 6 is especially suitable in a preferred manner if adjustability of the blowing direction as well as spacing of the blowing unit 21 from the leading edge 9 of the sheet is considered to be desirable.

With both of the herein aforedescribed embodiments of the invention, curling up of the leading edge 9 of the sheet may be inhibited or prevented to the effect that it is flattened out under the action of the air jet 20, the effective air jet 20 having a given scatter range 28 especially in a plane parallel to the plane of the sheet 3.

The supply system for the blowing or compressed air as well as the control system for the rate and timing thereof is shown diagrammatically and schematically in FIG. 6. It is believed to be readily apparent from that figure that the air supply rate which depends upon the nature of the material in which the printing takes place may be controlled, for example, by means of a throttle valve, and, in fact, automatically by an electro magnetically operated throttle valve, which is responsive to a conventional sensor electing the rate of delivery of the sheet and should present no difficulties to a person skilled in the art.

It is, furthermore, readily possible to control the air jet, by means of a rotary valve, for example, to the effect that the air jet acts or takes effect within a limited time peiod which is considered to be adequate, however, for the functioning of the blowing unit.

I claim:

1. In a delivery system of a sheet-fed rotary printing machine having a conveyor for transporting a sheet in a given travel direction to a location of the delivery system at which a stack of sheets is deposited, a device for inhibiting curl formation in a leading edge of the sheet, comprising means for downwardly directing the sheet at the location at which the stack of sheets is deposited, and blowing units exclusively disposed at a location of the delivery system whereat, as viewed in the given travel direction of the sheet, a forward region of the stack of delivered sheets and a leading edge of the downwardly directed sheet are disposed, said blowing units having respective means located at opposite sides of the forward region of the stack and at opposite edges of the sheet adjacent the leading edge thereof for directing a controlled air jet substantially parallel to the sheet, with one directional component in the travel direction of the sheet and another directional component towards the middle of the sheet, along the underside of the downwardly directed sheet in vicinity of the leading edge of the sheet tending to curl, said blowing units, respectively, comprising a housing block formed with a threaded bore and air outlet openings for supplying air thereto via a hose connection and a check valve, and fastening means for fastening said housing block to a respective lateral sheet straightener.

2. Device according to claim 1, wherein said air jet has a given scattering range in the plane of the sheet.

3. Device according to claim 1, wherein said blowing units have means for continuously operating said air jets.

4. Device according to claim 1, wherein said blowing units have means for operating said air jets at regular time intervals matching the speed of the sheet delivery.

* * * * *